US011306279B2

(12) United States Patent
Piorkowski

(10) Patent No.: US 11,306,279 B2
(45) Date of Patent: Apr. 19, 2022

(54) USE OF GLYCOL ETHER TO CONTROL RHEOLOGY OF UNIT DOSE DETERGENT PACK

(71) Applicant: Henkel IP & Holding GmbH, Duesseldorf (DE)

(72) Inventor: Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 97 days.

(21) Appl. No.: 16/547,280

(22) Filed: Aug. 21, 2019

(65) Prior Publication Data

US 2021/0054314 A1 Feb. 25, 2021

(51) Int. Cl.

| | |
|---|---|
| ***C11D 17/04*** | (2006.01) |
| ***C11D 1/04*** | (2006.01) |
| ***C11D 1/22*** | (2006.01) |
| ***C11D 1/29*** | (2006.01) |
| ***C11D 1/83*** | (2006.01) |
| ***C11D 3/20*** | (2006.01) |
| ***C11D 3/30*** | (2006.01) |
| ***C11D 3/386*** | (2006.01) |
| ***C11D 3/50*** | (2006.01) |
| ***C11D 3/00*** | (2006.01) |
| *C11D 1/14* | (2006.01) |
| *C11D 1/74* | (2006.01) |
| *C11D 1/66* | (2006.01) |

(52) U.S. Cl.

CPC ..... *C11D 17/043* (2013.01); *C11D 1/83* (2013.01); *C11D 3/0089* (2013.01); *C11D 3/2065* (2013.01); *C11D 3/2068* (2013.01); *C11D 3/30* (2013.01); *C11D 3/386* (2013.01); *C11D 3/50* (2013.01); *C11D 1/146* (2013.01); *C11D 1/22* (2013.01); *C11D 1/667* (2013.01); *C11D 1/74* (2013.01)

(58) Field of Classification Search

None

See application file for complete search history.

(56) References Cited

U.S. PATENT DOCUMENTS

| | | | | |
|---|---|---|---|---|
| 3,812,041 | A | 5/1974 | Inamorato | |
| 4,744,916 | A | 5/1988 | Adams | |
| 6,482,792 | B2 | 11/2002 | Ip | |
| 6,566,317 | B2 | 5/2003 | Morris et al. | |
| 2004/0063598 | A1* | 4/2004 | Riebe | C11D 17/0039 510/293 |
| 2004/0077519 | A1 | 4/2004 | Price et al. | |
| 2006/0094617 | A1 | 5/2006 | Price et al. | |
| 2015/0329807 | A1* | 11/2015 | Naqvi | C11D 3/2041 206/524.7 |
| 2019/0233768 | A1* | 8/2019 | Piorkowski | C11D 1/83 |

FOREIGN PATENT DOCUMENTS

| | | | |
|---|---|---|---|
| CA | 1293905 | C | 1/1992 |
| GB | 2209342 | A | 5/1989 |

OTHER PUBLICATIONS

Piorkowski, Daniel T., U.S. Appl. No. 16/231,309, "Use of Ethyleneoxy and Propyleneoxy Copolymer to Control Rheology of Unit Dose Detergent Pack", filed Dec. 21, 2018.

Piorkowski, Daniel T. et al., U.S. Appl. No. 16/231,232, "Use of Ionic Liquids to Control Rheology of Unit Dose Detergent Compositions," filed Dec. 21, 2018.

Piorkowski, Daniel T. et al., U.S. Appl. No. 16/231,269 entitled, "Use of Polyglycols to Control Rheology of Unit Dose Detergent Compositions," filed Dec. 21, 2018.

Piorkowski, Daniel T. et al., U.S. Appl. No. 16/231,298, "Use of Alkoxylated Polyamines to Control Rheology of Unit Dose Detergent Compositions," filed Dec. 21, 2018.

* cited by examiner

*Primary Examiner* — Lorna M Douyon

(74) *Attorney, Agent, or Firm* — Bojuan Deng

(57) ABSTRACT

A unit dose detergent pack includes a pouch made of a water-soluble film and a detergent composition encapsulated within the pouch. The detergent composition consists essentially of a rheology modified surfactant system and at least one adjunct. The rheology modified surfactant system consists of a surfactant blend including an alcohol ethoxy sulfate having a $C_8$-$C_{20}$ backbone that is ethoxylated with from about 1 to about 10 moles of ethylene oxide and is present in an amount of from about 5 to about 30 weight percent actives. The detergent composition also consists essentially of a rheology modifying agents consisting of water present in a total amount of from about 5 to about 30 weight percent and a glycol ether present in an amount of from about 0.5 to about 20 weight percent.

16 Claims, 2 Drawing Sheets

USE OF GLYCOL ETHER TO CONTROL RHEOLOGY OF UNIT DOSE DETERGENT PACK

FIELD OF THE INVENTION

The present disclosure generally relates to a unit dose pack that includes a detergent composition, and methods of forming both the composition and the pack. More specifically, the disclosure relates to inclusion of a glycol ether which facilitates dilution of a detergent composition.

BACKGROUND OF THE INVENTION

Many current detergent compositions include surfactants, such as sodium laureth sulfate. However, these types of surfactants typically increase in viscosity upon dilution with water. For example, detergent compositions that that include sodium laureth sulfate are known to be potentially difficult to work with because of the tendency to increase in viscosity and form near solid masses that can be difficult to dissolve. For example, such detergent compositions can have viscosities upon dilution with water that approach and exceed 100 Pa·s when measured at a shear rate of 0.41 1/sec using commonly available rheometers. One commercially available product exhibits non-Newtonian characteristics and is difficult to handle due to its high viscosity of about 33 Pa·s when measured at a shear rate of 1.08 1/sec using commonly available rheometers.

If these surfactants increase in viscosity in unit dose packs, the compositions are not suitable for cleaning various surfaces and stains because the surfactants do not homogeneously disperse in water. Moreover, even if the surfactants undergo an increased viscosity phase and then break apart, their cleaning effectiveness is still reduced. Accordingly, there remains an opportunity for improvement. Furthermore, other desirable features and characteristics of the present disclosure will become apparent from the subsequent detailed description of the disclosure and the appended claims, taken in conjunction this background of the disclosure.

SUMMARY OF THE INVENTION

This disclosure provides a unit dose detergent pack including a pouch made of a water-soluble film and a detergent composition encapsulated within the pouch. The detergent composition consists essentially of a rheology modified surfactant system and at least one adjunct. The rheology modified surfactant system consists of a surfactant blend including an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition. The detergent composition also consists essentially of a rheology modifying agents consisting of water present in a total amount of from about 5 to about 30 weight percent based on a total weight of the detergent composition and a glycol ether present in an amount of from about 0.5 to about 20 weight percent based on a total weight of the detergent composition. Moreover, the detergent composition has a viscosity of less than about 5,000 cps when diluted with additional water, the at least one adjunct does not affect the viscosity of the detergent composition more than ±5%, and the detergent composition is free of ionic liquids, polyglycols, alkoxylated polyamines, glycol and ethanol blends, poloxamers and alkyl alcohol blends, and combinations thereof.

This disclosure also provides a detergent composition consisting of a rheology modified surfactant system and at least one adjunct chosen from glycerine, propylene glycol, monoethanolamine, a bittering agent, an enzyme, an optical brightener, a chelator, a fragrance, and combinations thereof. The rheology modified surfactant system consists of a surfactant blend comprising an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of said detergent composition, a linear alkylbenzene sulfonate present in an amount of from about 1 to about 20 weight percent actives based on a total weight of said detergent composition and an ethoxylated alcohol present in an amount of from about 1 to about 30 weight percent actives based on a total weight of said detergent composition, and a rheology modifying agent. The rheology modifying agent consists of water present in a total amount of from about 5 to about 30 weight percent based on a total weight of said detergent composition, and a glycol ether present in an amount of from about 0.5 to about 20 weight percent based on a total weight of said detergent composition. The detergent composition has a viscosity of less than about 5,000 cps when diluted with additional water. Moreover, the at least one adjunct does not affect the viscosity of the detergent composition more than ±5%. In addition, the detergent composition is free of ionic liquids, polyglycols, alkoxylated polyamines, glycol and ethanol blends, poloxamers and alkyl alcohol blends, and combinations thereof.

The detergent composition exhibits superior and unexpected results. More specifically, the glycol ether surprisingly reduces the viscosity of the detergent composition upon dilution with water which, in turn, allows for larger amounts of water to be included in unit dose packs, allows for simplified formulations to be produced, less chemicals to be used, less chemical waste to be generated, and decreased production costs to be realized. Moreover, the glycol ether allows the detergent compositions to maintain cleaning effectiveness after dilution due to the decreased viscosity. This allows the packs to be used in a wider variety of environments.

The glycol ether also allows for increased cleaning effectiveness. Compositions of this disclosure are also able to exit a partially dissolved unit dose pack with greater ease as well since a water-soluble film could take up upwards of five minutes to dissolve. The water-soluble film of the unit dose pack normally partially dissolves in one area, allowing the contents to leech into the external environment prior to all of the water-soluble film dissolving. Higher viscosity liquids have a more difficult time exiting a partially dissolved unit dose pack and thus take longer to leech. This increases cleaning time and may also decrease cleaning effectiveness.

Moreover, the glycol ether allows the detergent composition to maintain a consistent low viscosity profile to enhance hydration and to enhance its dissolution profile as well.

Without wishing to be bound by theory, it is believed that by incorporating the rheology modifying agent, the detergent composition not only shows a trend of changing the behavior of the fluids (from non-Newtonian to Newtonian) but also lowering the viscosity of the detergent composition upon dilution with water, compared to when the rheology modifying agent is not added. Both are advantageous for dissolution of the unit dose detergent product when it is used in a washing machine. In other words, the present inventions provides a detergent composition with a Newtonian or approximate Newtonian behavior during hydration.

BRIEF DESCRIPTION OF THE DRAWINGS

The present disclosure will hereinafter be described in conjunction with the following Figures, wherein.

DETAILED DESCRIPTION OF THE INVENTION

Figure 1:
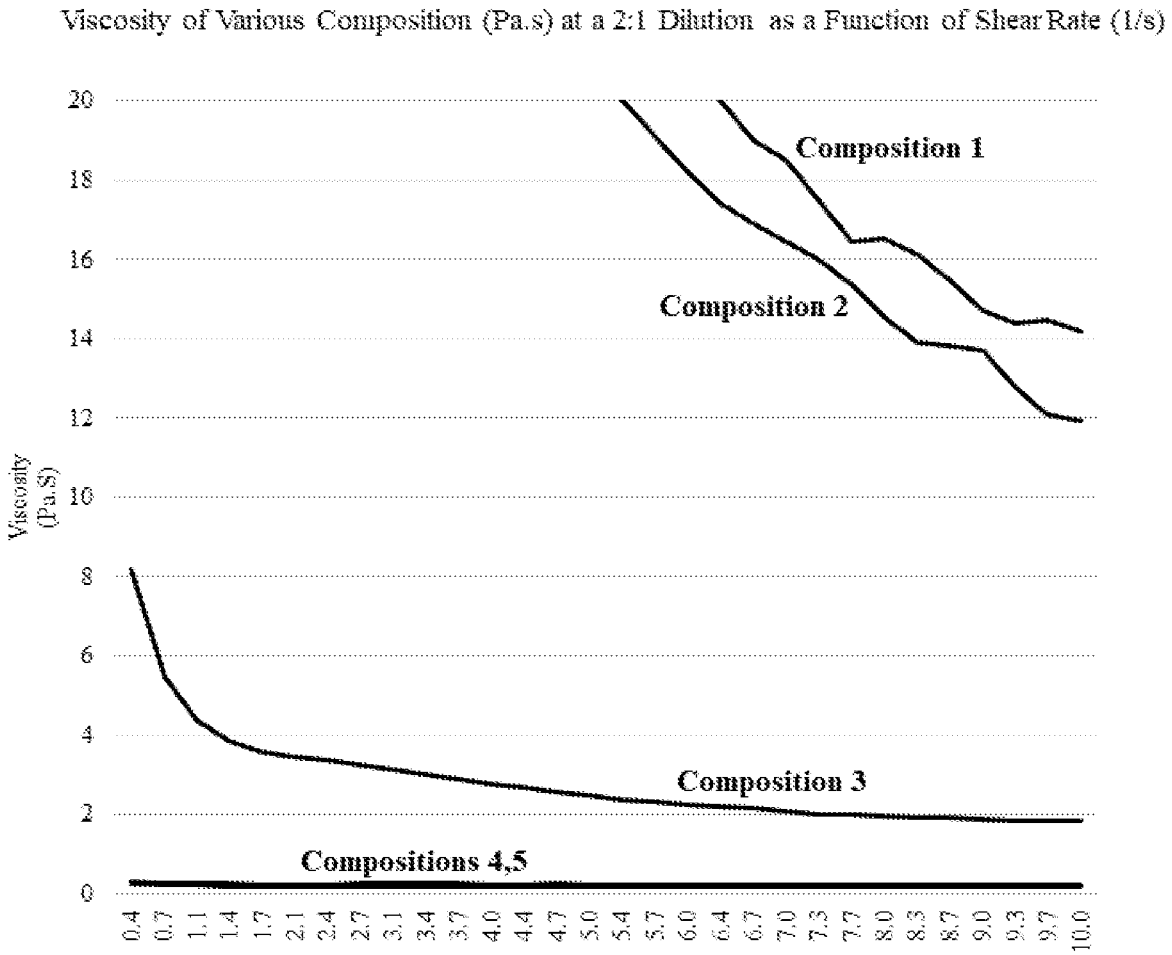
FIG. 1 is a line graph of Viscosity of Compositions 1-5 - Diluted 2:1 With Water—as a Function of Shear Rate, as set forth in the Examples.

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

In one aspect, the present disclosure provides a detergent composition with a consistent, low viscosity profile during hydration and dissolution. The detergent composition may comprise a particular surfactant, water, and a particular glycol ether, as described in detail below. Of the components, the glycol ether is a rheology modifying agent. The detergent composition may be used in a unit dose pack detergent product.

In another aspect, the present disclosure provides a method for modifying rheology of a detergent composition. The method includes the step of providing the detergent composition of this disclosure. The method also includes the step of diluting the detergent composition with additional water such that the detergent composition has a viscosity of less than about 5,000 cps. For example, this viscosity may be measured when the detergent composition is diluted with the water at about a 2:1 weight ratio of detergent composition:water.

It was unexpectedly discovered that, as a result of incorporating the rheology modifying agent, the detergent composition shows a trend of changing the behavior of the fluids, from non-Newtonian to Newtonian. A Newtonian fluid is a fluid wherein the ratio between shear stress changes linearly in proportion to the stress to which it is exposed. This proportion is known as viscosity. A Newtonian fluid exhibits a consistent viscosity level. More specifically, Newtonian fluids also typically exhibit a commensurate, linear increase in shear stress with increases in shear rate, while non-Newtonian fluids exhibit a non-linear relationship between shear stress and shear rate. Various non-Newtonian fluids can exhibit shear thickening (i.e., an increase in viscosity with increased shear rates) or shear thinning (i.e., a decrease in viscosity with increased shear rate). Non-Newtonian fluids that exhibit shear thinning may have a yield point. The yield point is an oscillation stress at which steeper declines in viscosity are produced, as indicated by shear modulus (G') decline, with further increases in the oscillation stress beyond the yield point also producing the steeper decline in shear modulus. At oscillation stress below the yield point, changes in shear rate with stress have a minimal to no impact on the viscosity of the material. At oscillation stress above the yield point, the material begins to exhibit rapid viscosity decreases with increased levels of stress.

It was also unexpectedly discovered that incorporation of the rheology modifying agent in a detergent composition also lowers the viscosity of the detergent composition upon dilution with water, compared to when the rheology modifying agent is not added. The consistent, low viscosity profile is advantageous for dissolution of the unit dose detergent product when it is used in a washing machine.

Unit Dose Pack:

This disclosure provides a unit dose pack that includes a pouch made of a water-soluble film and a detergent composition encapsulated within the pouch, each as described below.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example,) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

Detergent Composition

This disclosure provides the detergent composition, first introduced above and hereinafter referred to as a composition. The composition may consist essentially of or consist of, a rheology modified surfactant system and at least one adjunct. The rheology modified surfactant system consists of a surfactant blend including an alcohol ethoxy sulfate and a rheology modifying agent. The rheology modifying agent consists of water present in a total amount of from about 5 to about 30 weight percent based on a total weight of the detergent composition and a glycol ether present in an amount of from about 0.5 to about 20 weight percent based on a total weight of the detergent composition. Each is described below.

In one embodiment, the detergent composition consists essentially of:

A. a rheology modified surfactant system consisting of:

(1) a surfactant blend comprising an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In another embodiment, the detergent composition consists of:

A. a rheology modified surfactant system consisting of:

(1) a surfactant blend comprising an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In another embodiment, the detergent composition consists of:

A. a rheology modified surfactant system consisting of:

(1) a surfactant blend consisting essentially of an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In another embodiment, the detergent composition consists of:

A. a rheology modified surfactant system consisting of:

(1) a surfactant blend consisting of an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In one embodiment, the detergent composition consists essentially of: A.

a rheology modified surfactant system consisting of:

(1) a surfactant blend comprising a coconut oil fatty acid and an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In one embodiment, the detergent composition consists essentially of:

A. a rheology modified surfactant system consisting of:

(1) a surfactant blend comprising an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition, a linear alkylbenzene sulfonate present in an amount of from about 1 to about 20 weight percent actives based on a total weight of the detergent composition, and an ethoxylated alcohol present in an amount of from about 1 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In another embodiment, the detergent composition consists of:

A. a rheology modified surfactant system consisting of:

(1) a surfactant blend comprising an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition, a linear alkylbenzene sulfonate present in an amount of from about 1 to about 20 weight percent actives based on a total weight of the detergent composition, and an ethoxylated alcohol present in an amount of from about 1 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In another embodiment, the detergent composition consists of:

A. a rheology modified surfactant system consisting of:

(1) a surfactant blend consisting essentially of an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition, a linear alkylbenzene sulfonate present in an amount of from about 1 to about 20 weight percent actives based on a total weight of the detergent composition, and an ethoxylated alcohol present in an amount of from about 1 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In another embodiment, the detergent composition consists of:

A. a rheology modified surfactant system consisting of:

(1) a surfactant blend consisting of an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition, a linear alkylbenzene sulfonate present in an amount of from about 1 to about 20 weight percent actives based on a total weight of the detergent composition, and an ethoxylated alcohol present in an amount of from about 1 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

In one embodiment, the detergent composition consists essentially of:

A. a rheology modified surfactant system consisting of:

(1) a surfactant blend comprising a coconut oil fatty acid and an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition, a linear alkylbenzene sulfonate present in an amount of from about 1 to about 20 weight percent actives based on a total weight of the detergent composition, and an ethoxylated alcohol present in an amount of from about 1 to about 30 weight percent actives based on a total weight of the detergent composition; and (2) a rheology modifying agent consisting of:

(a) water present in a total amount of from about 5 to about 30 weight percent based on a total weight of the detergent composition; and (b) a glycol ether present in an amount of about 0.5 to about 20 weight percent based on a total weight of the detergent composition, and B. at least one adjunct.

Any one or more of the aforementioned embodiments may be further defined as including any one or more of the additional limitations set forth below. For example:

In one embodiment, the glycol ether is further defined as the reaction product of an alcohol and from 1 to 3 moles of ethylene oxide, wherein the alcohol is chosen from methanol, ethanol, propanol, butanol, hexanol, and combinations thereof.

In another embodiment, the glycol ether is further defined as the reaction product of butanol and from 1 to 3 moles of ethylene oxide.

In another embodiment, the glycol ether is further defined as diethylene glycol monobutyl ether.

In another embodiment, the glycol ether is further defined as ethylene glycol monobutyl ether.

In another embodiment, the glycol ether is present in an amount of about 2.5 weight percent based on a total weight of the detergent composition and In another embodiment, the viscosity of the detergent composition is less than about 4,500 cps when the detergent composition is diluted with additional water at about a 2:1 weight ratio of detergent composition:water, or the viscosity of the detergent composition is less than about 1,200 cps when the detergent composition is diluted with additional water at about a 1:1 weight ratio of detergent composition: water.

In another embodiment, the glycol ether is present in an amount of about 5 weight percent based on a total weight of the detergent composition and In another embodiment, the viscosity of the detergent composition is less than about 275 cps when the detergent composition is diluted with additional water at about a 2:1 weight ratio of detergent composition:water or the viscosity of the detergent composition is less than about 400 cps when the detergent composition is diluted with additional water at about a 1:1 weight ratio of detergent composition:water.

In another embodiment, the glycol ether is present in an amount of about 7.5 weight percent based on a total weight of the detergent composition and In another embodiment, the viscosity of the detergent composition is less than about 210 cps when the detergent composition is diluted with additional water at about a 2:1 weight ratio of detergent composition:water or the viscosity of the detergent composition is less than about 230 cps when the detergent composition is diluted with additional water at about a 1:1 weight ratio of detergent composition:water.

In another embodiment, the glycol ether is present in an amount of from about 1 to about 7.5 parts by weight per 100 parts by weight of the detergent composition.

In another embodiment, the glycol ether is present in an amount of from about 2.5 to about 7.5 parts by weight per 100 parts by weight of the detergent composition.

In another embodiment, the glycol ether is present in an amount of from about 5 to about 7.5 parts by weight per 100 parts by weight of the detergent composition.

In another embodiment, the alcohol ethoxy sulfate and the glycol ether are present in a weight ratio of actives of the alcohol ethoxy sulfate to the glycol ether of about 16:(1 to 7.5).

In another embodiment, the surfactant blend further comprises linear alkylbenzene sulfonate and an ethoxylated alcohol.

In another embodiment, the alcohol ethoxy sulfate is sodium laureth sulfate ethoxylated with about 2 to about 4 moles of ethylene oxide, wherein the surfactant blend further comprises linear alkylbenzene sulfonate and an ethoxylated alcohol, wherein the glycol ether is diethylene glycol monobutyl ether, and wherein the sodium laureth sulfate, the linear alkylbenzene sulfonate, the ethoxylated alcohol, and the glycol ether are present in a weight ratio of actives of the alcohol ethoxy sulfate to the linear alkylbenzene sulfonate to the ethoxylated alcohol to the diethylene glycol monobutyl ether of about 16:5:7:(1 to 7.5).

In another embodiment, the surfactant blend further comprises an additional anionic surfactant and a non-ionic surfactant wherein the alcohol ethoxy sulfate, the additional anionic surfactant, the non-ionic surfactant, and the glycol ether are present in a weight ratio of actives of the alcohol ethoxy sulfate to the additional anionic to the non-ionic surfactant to the glycol ether of about 16:5:7:2.5.

In another embodiment, the surfactant blend further comprises an additional anionic surfactant and a non-ionic surfactant wherein the alcohol ethoxy sulfate, the additional anionic surfactant, the non-ionic surfactant, and the glycol ether are present in a weight ratio of actives of the alcohol ethoxy sulfate to the additional anionic to the non-ionic surfactant to the glycol ether of about 16:5:7:5.

In another embodiment, the surfactant blend further comprises an additional anionic surfactant and a non-ionic surfactant wherein the alcohol ethoxy sulfate, the additional anionic surfactant, the non-ionic surfactant, and the glycol ether are present in a weight ratio of actives of the alcohol ethoxy sulfate to the additional anionic surfactant to the non-ionic surfactant to the glycol ether of about 16:5:7:7.5.

In further embodiments, the composition is free of, or includes less than 1, 0.5, 0.1, 0.05, or 0.01, weight percent of, any one or more of the optional components or additives described below and/or those such as, but not limited to, cationic surfactants, amphoteric(zwitterionic surfactants), etc. In other embodiments, the detergent composition is free of, or includes less than 1, 0.5, 0.1, 0.05, or 0.01, weight percent of, ionic liquids, polyglycols, alkoxylated polyamines, glycol and ethanol blends, poloxamers and alkyl alcohol blends, and combinations thereof.

Rheology Modified Surfactant System

As first introduced above, the composition consists essentially of the rheology modified surfactant system and the adjunct, described in greater detail below. The rheology modified surfactant system consists of a surfactant blend and a rheology modifying agent.

The surfactant blend includes an alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the rheology modified surfactant system may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide.

The alcohol ethoxy sulfate can be present in an amount of from about 5 to about 30, about 10 to about 25, about 10 to about 20, or about 15 to about 20, weight percent actives based on a total weight of the composition. The entire weight of the surfactant blend may be the weight of the alcohol ethoxy sulfate itself without any additional surfactants included in this weight. Alternatively, other surfactants may be included in this weight percentage. In various non-limiting embodiments, all values, both whole and fractional, between and including all of the above, are hereby expressly contemplated for use herein.

Additional Surfactants:

The surfactant blend may include, be, consist essentially of, or consist of the alcohol ethoxy sulfate, as described above. Alternatively, the surfactant blend may include, be, consist essentially of, or consist of, the alcohol ethoxy sulfate and one or more additional surfactants described below. It is alternatively contemplated that the one or more additional surfactants may be part of the rheology modified surfactant system, as described above, or may be independent from the rheology modified surfactant system.

In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Linear Alkylbenzene Sulfonate

In one embodiment, the additional anionic surfactant is linear alkylbenzene sulfonate (LAS). The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. The additional anionic surfactant, e.g. the linear alkylbenzene sulfonate (LAS), may be present in an amount of from greater than about zero to about 20, e.g. about 1 to about 20, about 5 to about 20, about 5 to about 15, about 5 to about 10, about 10 to about 20, about 10 to about 15, about 15 to about 20, 1, 2, 3, 4, 5, 6, 7, 8, 9, 10, etc., weight percent actives based on a total weight of the composition. In various non-limiting embodiments, all values, both whole and fractional, between and including all of the above, are hereby expressly contemplated for use herein.

In some embodiments, the detergent composition is free of LAS.

Alkoxylated Alcohol

In another embodiment, the additional surfactant is a non-ionic surfactant. This non-ionic surfactant may be a $C_8$-$C_{20}$ alcohol that is capped with (or comprises) approximately 2 to 12 moles of an alkylene oxide. In other embodiments, this non-ionic surfactant is an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein. The additional surfactant, e.g. the aforementioned alkoxylated alcohol, may be present in an amount of from greater than about zero to about 30, e.g. about 1 to about 30, about 3 to about 30, about 5 to about 30, about 10 to about 25, about 15 to about 20, about 20 to about 25, about 25 to about 30, about 20 to about 30, about 15 to about 25, about 20, 21, 22, 23, 24, 25, etc., weight percent actives based on a total weight of the composition. In various non-limiting embodiments, all values, both whole and fractional, between and including all of the above, are hereby expressly contemplated for use herein.

Anionic and Non-Ionic Surfactants:

In other embodiments, the one or more additional surfactants may be or include anionic surfactants which include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

In one embodiment, the additional anionic surfactant is linear alkylbenzene sulfonate and the non-ionic surfactant is an ethoxylated alcohol. In another embodiment, the ethoxylated alcohol comprises a $C_8$-$C_{20}$ backbone that is ethoxylated with from about 2 to about 12 moles of ethylene oxide. In another embodiment, the ethoxylated alcohol comprises a $C_{12}$-$C_{14}$ backbone that is ethoxylated with from about 6 to about 8 moles of ethylene oxide. In a further embodiment, the alcohol ethoxy sulfate is sodium laureth sulfate and the sodium laureth sulfate, the linear alkylbenzene sulfonate, and the ethoxylated alcohol are present in a weight ratio of about 0.2:1:0.2 to about 5:1:5. In one embodiment, the sodium laureth sulfate, the linear alkylbenzene sulfonate, and the ethoxylated alcohol are present in a weight ratio of about 3:1:5. In various non-limiting embodiments, all values, both whole and fractional, between and including all of the above, are hereby expressly contemplated for use herein.

Water:

Referring back to the rheology modifying agent. The rheology modifying agent consists of the water and the glycol ether.

The water is present in an amount of from about 5 to about 30 weight percent based on a total weight of the composition. In various embodiments, water is present in a total amount of from about 5 to about 25, about 5 to about 20, about 10 to about 15, about 10 to about 18, about 15 to about 20, about 20 to about 25, or about 15 to about 25, weight percent based on a total weight of the composition. Typically, the terminology "total amount" refers to a total amount of water present in the composition from all components, i.e., not simply water added independently from, for example, the rheology modified surfactant system and/or the glycol ether. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Glycol Ether:

The glycol ether is a liquid and may contribute to the excellent flowability and usability of the composition in various cleaning environments. The glycol ether is typically utilized as a rheology modifying agent.

The glycol ether is present in an amount of from about 0.5 to about 20 weight percent based on a total weight of the composition. In various embodiments, the glycol ether is present in an amount of from about 0.5 to about 20, about 0.5 to about 1, about 0.5 to about 0.75, about 0.4 to about 1.5, about 0.5 to about 10, about 0.75 to about 7.5, about 1.5 to about 5, about 1 to about 15, about 1 to about 10, about 1 to about 7.5, about 1 to about 5, about 1 to about 2.5, about 2.5 to about 10, about 2.5 to about 7.5, about 2.5 to about 5, about 7.5 to about 10, about 5 to about 10, about 5 to about 7.5, about 10 to about 15, about 7.5 to about 15, about 5 to about 15, or about 2.5 to about 15, weight percent actives based on a total weight of the composition. In other embodiments, the glycol ether is present in an amount of about 1, about 2.5, about 5, about 7.5, about 10, about 12.5, about 15, about 17.5, or about 20, weight percent actives based on a total weight of the composition. In various non-limiting embodiments, all values, both whole and fractional, between and including all of the above, are hereby expressly contemplated for use herein.

The glycol ether may be a single glycol ether or may be a combination of glycol ethers. In other words, the glycol ether may be or include one or more individual glycol ethers, each independently as described herein or alternatively may be or include just one or more particular glycol ethers to the exclusion of one or more other glycol ethers.

In one embodiment, the glycol ether is further defined as the reaction product of an alcohol and from 1 to 3 moles of ethylene oxide, e.g. about 1, about 2, or about 3 moles of ethylene oxide. Alternatively, the glycol ether is further defined as the reaction product of an alcohol and from 1 to 3 moles of propylene oxide, e.g. about 1, about 2, or about 3 moles of propylene oxide. Alternatively, the glycol ether is further defined as the reaction product of an alcohol and from 1 to 3 moles of butylene oxide, e.g. about 1, about 2, or about 3 moles of butylene oxide. Even further, the glycol ether may be further defined as the reaction product of an alcohol and from 1 to 3 moles of a mixture of alkylene oxides, e.g. ethylene oxide, and/or propylene oxide, and/or butylene oxide, e.g. about 1, about 2, or about 3 moles of the mixture of alkylene oxides. In various non-limiting embodiments, all values, both whole and fractional, between and including all of the above, are hereby expressly contemplated for use herein.

In other embodiments, the alcohol may be any known in the art. For example, the alcohol may be chosen from methanol, ethanol, propanol, butanol, hexanol, and combinations thereof.

In one embodiment, the glycol ether is further defined as the reaction product of butanol and from 1 to 3 moles of ethylene oxide.

For example, the glycol ether may be further defined as diethylene glycol monobutyl ether.

In another embodiments, the glycol ether is further defined as ethylene glycol monobutyl ether.

In various embodiments, the glycol ether is chosen from ethylene glycol monomethyl ether (2-methoxyethanol, $CH_3OCH_2CH_2OH$); ethylene glycol monoethyl ether (2-ethoxyethanol, $CH_3CH_2OCH_2CH_2OH$); ethylene glycol monopropyl ether (2-propoxyethanol, $CH_3CH_2CH_2OCH_2CH_2OH$), ethylene glycol monoisopropyl ether (2-isopropoxyethanol, $(CH_3)_2CHOCH_2CH_2OH$); ethylene glycol monobutyl ether (2-butoxyethanol, $CH_3CH_2CH_2CH_2OCH_2CH_2OH$); ethylene glycol monophenyl ether (2-phenoxyethanol, $C_6H_5OCH_2CH_2OH$); ethylene glycol monobenzyl ether (2-benzyloxyethanol, $C_6H_5CH_2OCH_2CH_2OH$); propylene glycol methyl ether, (1-methoxy-2-propanol, $CH_3OCH_2CH(OH)CH_3$); diethylene glycol monomethyl ether (2-(2-methoxyethoxy)ethanol, methyl carbitol, $CH_3OCH_2CH_2OCH_2CH_2OH$), diethylene glycol monoethyl ether (2-(2-ethoxyethoxy)ethanol, carbitol cellosolve, $CH_3CH_2OCH_2CH_2OCH_2CH_2OH$), diethylene glycol mono-n-butyl ether (2-(2-butoxyethoxy)ethanol, butyl carbitol, $CH_3CH_2CH_2CH_2OCH_2CH_2OCH_2CH_2OH$); dipropyleneglycol methyl ether; or combinations thereof.

In still other embodiments, the glycol ether may be as set forth in Table 1 below:

TABLE 1

| Ethylene Oxide (mol) | Methanol | Ethanol | Propanol | Butanol | Hexanol |
|---|---|---|---|---|---|
| 1 | Ethylene glycol monomethyl ether | Ethylene glycol monoethyl ether | Ethylene glycol monopropyl ether | Ethylene glycol monobutyl ether | Ethylene glycol monohexyl ether |
| 2 | Diethylene glycol monomethyl ether | Diethylene glycol monoethyl ether | Diethylene glycol monopropyl ether | Diethylene glycol monobutyl ether | Diethylene glycol monohexyl ether |
| 3 | Triethylene glycol monomethyl ether | Triethylene glycol monoethyl ether | Triethylene glycol monopropyl ether | Triethylene glycol monobutyl ether | Triethylene glycol monohexyl ether |

In one embodiment, the glycol ether is formed from the reaction of n-butanol and one mole of ethylene oxide and is commonly known as ethylene glycol monobutyl ether or Butyl Cellosolve. In another embodiment, the glycol ether is formed from reaction of n-butanol and two moles of ethylene oxide and is commonly known as diethylene glycol monobutyl ether or Butyl Carbitol.

Non-Aqueous Solvent

In some embodiments, the composition may include a non-aqueous solvent. In various embodiments, the non-aqueous solvent is present in an amount of from about 1 to about 30, about 3 to about 30, about 5 to about 30, about 10 to about 25, or about 15 to about 20, weight percent based on a total weight of the composition. In various non-limiting embodiments, all values, both whole and fractional, between and including all of the above, are hereby expressly contemplated for use herein.

The non-aqueous solvent is not particularly limited and may be any known in the art. In various embodiments, the non-aqueous solvent is chosen from glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide /propylene oxide block copolymers. In various non-limiting embodiments, all values, both whole and fractional, between and including all of the above, are hereby expressly contemplated for use herein.

In other embodiments, the composition is free of the non-aqueous solvent.

Additives/Adjuncts:

The composition may include one or more of the following additives/adjuncts or may be free of one or more of the following additives/adjuncts. In various embodiments, the additives/adjuncts do not affect the viscosity of the detergent composition more than ±0.5, 1, 2, 3, 4, or 5, %. In various non-limiting embodiments, it is contemplated that anywhere the terminology "additive" is used herein, the terminology "adjunct" may be substituted. In various non-limiting embodiments, all values, both whole and fractional, between and including all of the above, are hereby expressly contemplated for use herein.

For example, the composition may include one or more foam inhibitors (e.g. defoaming agents). Suitable foam inhibitors include, but are not limited to, fatty acids such as coconut fatty acids. The composition may include the foam inhibitor at an amount of from about 0 to about 10 weight percent, based on the total weight of the composition. In various non-limiting embodiments, all values, both whole and fractional, between and including all of the above, are hereby expressly contemplated for use herein.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art.

In one embodiment, the composition is free of, or includes less than 5, 4, 3, 2, 1, 0.5, or 0.1, weight percent of, a solvent other than water, e.g. any organic solvent, non-polar solvent, polar aprotic solvent, polar protic solvent, etc. and combinations thereof. In another embodiment, the composition is free of, or includes less than 5, 4, 3, 2, 1, 0.5, or 0.1, weight percent of, propylene glycol and/or glycerine. In various non-limiting embodiments, all values, both whole and fractional, between and including all of the above, are hereby expressly contemplated for use herein.

Weight Percents/Ratios of Various Components:

The components of this disclosure are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In various embodiments, the glycol ether is present in an amount of about 1, about 2.5, about 5, or about 7.5, weight based on a total weight of the composition, and water is present in a weight ratio with the composition of about 1:2.

In other embodiments, the glycol ether is present in an amount of about 1, about 2.5, about 5, or about 7.5, weight percent based on a total weight of the composition, and water is present in a weight ratio with the composition of about 1:1.

In still other embodiments, the surfactant blend is present in an amount of about 15 to about 16 weight percent actives based on a total weight of the composition, the glycol ether is present in an amount of about 1, about 2.5, about 5, or about 7.5, weight percent based on a total weight of the composition, and water is present in a weight ratio with the composition of about 1:2.

In other embodiments, the surfactant blend is present in an amount of about 15 to about 16 weight percent actives based on a total weight of the composition, the glycol ether is present in an amount of about 1, about 2.5, about 5, or about 7.5, weight percent based on a total weight of the composition, and water is present in a weight ratio with the composition of about 1:1.

In further embodiments, the surfactant blend is present in an amount of about 15 to about 16 weight percent actives based on a total weight of the composition, the glycol ether is present in an amount of about 1, about 2.5, about 5, or about 7.5, weight percent based on a total weight of the composition, water is present in a weight ratio with the composition of about 1:2, and the additional anionic surfactant is present in an amount of from greater than about zero to about 20, e.g. about 5, weight percent actives based on a total weight of the composition.

In other embodiments, the surfactant blend is present in an amount of about 15 to about 16 weight percent actives based on a total weight of the composition, the glycol ether is present in an amount of about 1, about 2.5, about 5, or about 7.5, weight percent based on a total weight of the composition, and water is present in a weight ratio with the composition of about 1:1, and the additional anionic surfactant is present in an amount of from greater than about zero to about 20, e.g. about 5, weight percent actives based on a total weight of the composition.

In further embodiments, the surfactant blend is present in an amount of about 15 to about 16 weight percent actives based on a total weight of the composition, the glycol ether is present in an amount of about 1, about 2.5, about 5, or about 7.5, weight percent based on a total weight of the composition, water is present in a weight ratio with the composition of about 1:2, the additional anionic surfactant is present in an amount of from greater than about zero to about 20, e.g. about 5, weight percent actives based on a total weight of the composition, and a non-ionic surfactant is present in an amount of from about 3 to about 30, e.g. about 23, weight percent actives based on a total weight of the composition.

In other embodiments, the surfactant blend is present in an amount of about 15 to about 16 weight percent actives based on a total weight of the composition, the glycol ether is present in an amount of about 1, about 2.5, about 5, or about 7.5, weight percent based on a total weight of the composition, and water is present in a weight ratio with the composition of about 1:1, the additional anionic surfactant is present in an amount of from greater than about zero to about 20, e.g. about 5, weight percent actives based on a total weight of the composition, and a non-ionic surfactant is present in an amount of from about 3 to about 30, e.g. about 23, weight percent actives based on a total weight of the composition.

In even further embodiments, the actives of the surfactant blend, water, and the glycol ether are present in weight ratios of about 15:15:1; about 15:15:2.5; about 15:15:5, or about 15:15:7.5, or any range therebetween. In various non-limiting embodiments, all values, both whole and fractional, between and including all of the above, are hereby expressly contemplated for use herein.

In even further embodiments, the actives of the surfactant blend, water, the glycol ether, and the actives of the additional anionic surfactant are present in weight ratios of about 15:15:1:5; about 15:15:2.5:5; about 15:15:5:5, or about 15:15:7.5:5, or any range therebetween. In various non-limiting embodiments, all values, both whole and fractional, between and including all of the above, are hereby expressly contemplated for use herein.

In even further embodiments, the actives of the surfactant blend, water, the glycol ether, and the actives of the non-ionic surfactant are present in weight ratios of about 15:15:1:23; about 15:15:2.5:23; about 15:15:5:23, or about 15:15:7.5:23, or any range therebetween. In various non-limiting embodiments, all values, both whole and fractional, between and including all of the above, are hereby expressly contemplated for use herein.

In even further embodiments, the actives of the surfactant blend, water, the glycol ether, the actives of the additional anionic surfactant, and the actives of the non-ionic surfactant are present in weight ratios of about 15:15:1:5:23; about 15:15:2.5: 5:23; about 15:15:5: 5:23, or about 15:15:7.5: 5:23, or any range therebetween.

In another embodiment, the alcohol ethoxy sulfate, the additional anionic surfactant, and the non-ionic surfactant are present in a weight ratio of about 0.2:1:0.2 to about 5:1:5.

In a further embodiment, the glycol ether is present in an amount of about 1 weight percent based on a total weight of the detergent composition and the viscosity of the detergent composition is less than about 1,800 cps when the detergent composition is diluted with additional water at about a 1:1 weight ratio of detergent composition:water.

In a further embodiment, the glycol ether is present in an amount of about 2.5 weight percent based on a total weight of the detergent composition and the viscosity of the detergent composition is less than about 4,500 cps when the detergent composition is diluted with additional water at about a 2:1 weight ratio of detergent composition:water, or the viscosity of the detergent composition is less than about 1,200 cps when the detergent composition is diluted with additional water at about a 1:1 weight ratio of detergent composition:water.

In a further embodiment, the glycol ether is present in an amount of about 5 weight percent based on a total weight of the detergent composition and the viscosity of the detergent composition is less than about 275 cps when the detergent composition is diluted with additional water at about a 2:1 weight ratio of detergent composition:water or the viscosity of the detergent composition is less than about 400 cps when the detergent composition is diluted with additional water at about a 1:1 weight ratio of detergent composition:water.

In a further embodiment, the glycol ether is present in an amount of about 7.5 weight percent based on a total weight of the detergent composition and the viscosity of the detergent composition is less than about 210 cps when the detergent composition is diluted with additional water at about a 2:1 weight ratio of detergent composition:water or the viscosity of the detergent composition is less than about 230 cps when the detergent composition is diluted with additional water at about a 1:1 weight ratio of detergent composition:water.

In a further embodiment, the glycol ether is present in an amount of from about 1 to about 7.5 parts by weight per 100 parts by weight of the detergent composition.

In a further embodiment, the glycol ether is present in an amount of from about 2.5 to about 7.5 parts by weight per 100 parts by weight of the detergent composition.

In a further embodiment, the glycol ether is present in an amount of from about 5 to about 7.5 parts by weight per 100 parts by weight of the detergent composition.

In a further embodiment, the alcohol ethoxy sulfate and the glycol ether are present in a weight ratio of actives of the alcohol ethoxy sulfate to the glycol ether of about 16:(1 to 7.5).

In a further embodiment, the alcohol ethoxy sulfate is sodium laureth sulfate ethoxylated with about 2 to about 4 moles of ethylene oxide, wherein the surfactant blend further comprises linear alkylbenzene sulfonate and an ethoxylated alcohol, wherein the glycol ether is diethylene glycol monobutyl ether, and wherein the sodium laureth sulfate, the linear alkylbenzene sulfonate, the ethoxylated alcohol, and the glycol ether are present in a weight ratio of actives of the alcohol ethoxy sulfate to the linear alkylbenzene sulfonate to the ethoxylated alcohol to the diethylene glycol monobutyl ether of about 16:5:7:(1 to 7.5).

In a further embodiment, the surfactant blend further comprises an additional anionic surfactant and a non-ionic surfactant wherein the alcohol ethoxy sulfate, the additional anionic surfactant, the non-ionic surfactant, and the glycol ether are present in a weight ratio of actives of the alcohol ethoxy sulfate to the additional anionic to the non-ionic surfactant to the glycol ether of about 16:5:7:1.

In a further embodiment, the surfactant blend further comprises an additional anionic surfactant and a non-ionic surfactant wherein the alcohol ethoxy sulfate, the additional anionic surfactant, the non-ionic surfactant, and the glycol ether are present in a weight ratio of actives of the alcohol ethoxy sulfate to the additional anionic to the non-ionic surfactant to the glycol ether of about 16:5:7:2.5.

In a further embodiment, the surfactant blend further comprises an additional anionic surfactant and a non-ionic surfactant wherein the alcohol ethoxy sulfate, the additional anionic surfactant, the non-ionic surfactant, and the glycol ether are present in a weight ratio of actives of the alcohol ethoxy sulfate to the additional anionic to the non-ionic surfactant to the glycol ether of about 16:5:7:5.

In a further embodiment, the surfactant blend further comprises an additional anionic surfactant and a non-ionic surfactant wherein the alcohol ethoxy sulfate, the additional anionic surfactant, the non-ionic surfactant, and the glycol ether are present in a weight ratio of actives of the alcohol ethoxy sulfate to the additional anionic surfactant to the non-ionic surfactant to the glycol ether of about 16:5:7:7.5.

In various non-limiting embodiments, all values, both whole and fractional, between and including all of the above, are hereby expressly contemplated for use herein.

Physical Properties:

Typically, compositions that include alcohol ethoxy sulfates have viscosity issues upon dilution with water. However, the composition of the instant disclosure resists unwanted increases in viscosity upon dilution with water.

In various embodiments, the composition of this disclosure has a viscosity of less than about 5,000 cps when diluted with additional water at about a 2:1 weight ratio of composition: water. In various embodiments, the viscosity is less than about 4,500, about 4,000, about 3,500, about 3,000, about 2,500, about 2,000, about 1,500, about 1,000, about 500, about 265, or about 210, cps when diluted with additional water at about a 2:1 weight ratio of composition: water.

In other embodiments, the composition of this disclosure has a viscosity of less than about 5,000 cps when diluted with additional water at about a 1:1 weight ratio of composition : water. In various embodiments, the viscosity is less than about 4,500, about 4,000, about 3,500, about 3,000, about 2,500, about 2,000, about 1,800, about 1,500, about 1,200, about 1,000, about 500, about 400, or about 250, cps when diluted with additional water at about a 1:1 weight ratio of composition: water.

In still other embodiments, and as was introduced above, the viscosity is from about 100 to about 5,000, about 100 to about 4,500, about 100 to about 4,000, about 100 to about 3,500, about 100 to about 2,500, about 100 to about 2,000, from about 100 to about 1,500, from about 100 to about 1,000, from about 100 to about 500, from about 500 to about 1,000, about 200 to about 500, about 250 to about 450, about 300 to about 400, about 300 to about 350, about 350 to about 500, about 200 to about 265, about 200 to about 4,400, about 265 to about 4,400, about 230 to about 390, about 230 to about 1115, about 240 to about 1800, about 390 to about 1115, about 390 to about 1,800, about 1115 to about 1,800, etc.

In other embodiments, the dilution with water is at about 1:1 to about 1:0.33 of the composition: water. Typically, maximum increase in viscosity would be observed at about 2:1 composition: water such that particularly special unexpected results associated with minimized viscosity increase are observed at this approximate weight ratio. In various non-limiting embodiments, all values, both whole and fractional, between and including all of the above, are hereby expressly contemplated for use herein.

The viscosity of the composition, e.g. those described above, may be measured using various techniques. For example, the viscosity may be measured using a Brookfield viscometer and any one or more spindles, as is chosen by one of skill in the art. In various embodiments, the composition has one or more of the aforementioned viscosities measured using a DV2T Brookfield viscometer at 20 rpm and 70° F. using spindle LV02(62). Alternatively, the viscosity may be described as being measured using a rheometer, e.g. any known in the art. In various embodiments, the composition has one or more of the aforementioned viscosities measured using an AR2000-EX Rheometer at a shear rate of 1.08 1/s over 5 minutes at 20° C. with a geometry cone of 40 mm, 1:59:49 degree:min:sec, and a truncation gap of 52 microns. However, the shear rate, time, temperature, geometry cone, values for degree:min:sec, and truncation gap may all vary and be chosen by one of skill in the art. For example, the shear rate may be measured as is set forth in the Examples and Figures. In various non-limiting embodiments, all values, both whole and fractional, between and including all of the above, are hereby expressly contemplated for use herein.

Additional Embodiments:

In various additional embodiments, the alcohol ethoxy sulfate is sodium laureth sulfate ethoxylated with about 2 to about 4 moles of ethylene oxide and is present in an amount of from about 15 to about 16 weight percent actives based on a total weight of the detergent composition; water is present in a total amount of from about 10 to about 18 weight percent based on a total weight of the detergent composition; the glycol ether is present in an amount of about 1 to about 7.5 weight percent based on a total weight of the detergent composition, an ethoxylated alcohol comprising a $C_{12}$-$C_{14}$ backbone that is ethoxylated with from about 6 to about 8 moles of ethylene oxide is utilized; a defoaming agent and a solvent are utilized, and the detergent composition has a viscosity of less than about 4,400, 265, or 210, cps when diluted with additional water at about a 2:1 weight ratio of detergent composition:water. In a related embodiment, a linear alkylbenzene sulfonate is utilized. In various non-limiting embodiments, all values, both whole and fractional, between and including all of the above, are hereby expressly contemplated for use herein.

This disclosure also provides a detergent composition exhibiting approximate Newtonian behavior during hydration. The terminology "approximate Newtonian behavior" is as is understood by those of skill in the art, wherein Newtonian behavior is as described above. Moreover, the terminology "during hydration" typically describes a time when the detergent composition is diluted with water. As is described above, this dilution is typically effected using an independent source of water, such as DI water. The detergent composition includes the surfactant composition, water, and the glycol ether described above.

Method of Forming Unit Dose Pack:

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

Method of Forming the Detergent Composition:

This disclosure further provides a method of forming the detergent composition. The method includes the step of combining the components described above and optionally any additional solvents, surfactants, additives, adjuncts, etc., to form the detergent composition. Each of the aforementioned components may be combined in any order and in whole or partial amounts. Moreover, any of the aforementioned additives/adjuncts may be combined as well with one or more of the aforementioned fragrance, surfactant, or water. All orders of addition are hereby expressly contemplated for use in various non-limiting embodiments.

Method for Modifying Rheology of the Detergent Composition:

As first introduced above, this disclosure further provides a method for modifying rheology of the detergent composition. The method includes the step of providing a detergent composition that includes the aforementioned components. The step of providing may be any known in the art. The detergent composition may be provided after it is formed using the method described above.

The method also includes the step of diluting the detergent composition with additional water such that the detergent composition has a viscosity of less than about 5,000 cps when diluted with the additional water, e.g. water at about a 2:1 or about a 1:1, weight ratio of detergent composition: water. The step of diluting may be further defined as adding additional water to the detergent composition, such as from the independent source of DI water described above, to a desired dilution weight ratio. The step of diluting may be accomplished as a batch or continuous operation.

EXAMPLES

A masterbatch composition, as set forth below in Table 2 below, is used to form a series of compositions both representative of embodiments of this disclosure (Inventive) and comparative (Comp.). All values set forth in Table 2 are in parts by weight per 100 parts by weight of the Compositions. More specifically, the total weight of the masterbatch composition is 92.5 parts. The additional 7.5 parts is supplied either as glycerine alone (comparative), as 1, 2.5, or 5 wt % of the glycol ether with a balance of glycerine to total 7.5 parts (inventive), or as 7.5 parts of the glycol ether itself without any glycerine (inventive). All Compositions have a viscosity of approximately 100 to 230 cP as-is (i.e., without dilution) measured using an AR2000-EX Rheometer using an increasing shear rate of from about 0.41 to about 10 1/s over 5 minutes at 20° C. with a geometry cone of 40 mm, 1:59:49 degree:min:sec, and a truncation gap of 52 microns.

The glycol ether used is di -thylerie glycol mono-n-butyl ether, also known as 2-(2-butoxyethoxy)ethanol or butyl carbitol, with a chemical formula as: $CH_3CH_2CH_2CH_2OCH_2CH_2OCH_2CH_2OH$.

TABLE 2

| Masterbatch Composition | Parts |
|---|---|
| Glycerine | 7.370 |
| C12-C15 Alcohol Ethoxylate - 7 E/O | 23.074 |
| Propylene Glycol | 8.206 |
| Monoethanolamine | 3.150 |
| Water | 5.700 |
| Linear Alkylbenzene Sulfonate | 5.000 |
| Coconut Oil Fatty Acid | 10.000 |
| Sodium Laureth Ether Sulfate (~60 wt % actives) | 26.000 |
| Bitrex | 0.050 |
| Enzymes (~10 wt % actives) | 1.850 |
| Tinopal CBS-X Swiss | 0.200 |
| Chelator (~33 wt % actives) | 0.900 |
| Fragrance | 1.000 |
| Total | 92.500 |

In Table 2 above, the components are as follows:

C12-C15 Alcohol Ethoxylate—7 E/O is a $C_{12}$-$C_{15}$ Alcohol Ethoxylate that is capped with approximately 7 moles of ethylene oxide.

Linear Alkylbenzene Sulfonate is 2-Phenyl Sulfonic Acid.

Bitrex is a bittering additive, which is a 25% active solution in water.

Enzymes are a combination of commercially available proteases.

Tinopal CBS-X Swiss is an optical brightener.

The aforementioned Masterbatch Composition is used to form the following Compositions 1-5 wherein amounts of the glycol ether and/or amounts of an additional glycerine are added to the Masterbatch Composition such that a total of the Compositions 1-5 is about 100 parts:

Composition 1 (comparative): 0 parts of the glycol ether; 7.5 parts additional glycerine;

Composition 2 (inventive): 1 part of the glycol ether; 6.5 parts additional glycerine;

Composition 3 (inventive): 2.5 parts of the glycol ether; 5 parts additional glycerine;

Composition 4 (inventive): 5 parts of the glycol ether; 2.5 parts additional glycerine;

Composition 5 (inventive): 7.5 parts of the glycol ether; 0 parts additional glycerine.

The Compositions 1-5 are evaluated to determine viscosity using an AR2000-EX Rheometer using an increasing shear rate of from about 0.41 to about 10 1/s over 5 minutes at 20° C. with a geometry cone of 40 mm, 1:59:49 degree: min:sec, and a truncation gap of 52 microns.

In a first series of viscosity evaluations, the Compositions (Comp. 1-5) are diluted with additional water at a weight ratio of about 2 parts Composition: 1 part Water (e.g. 1 part Composition: 0.5 parts Water). The results of these evaluations are set forth in Table 3 below wherein viscosity is set forth as Pa·S.

In a second series of viscosity evaluations, the Compositions (Comp. 1-5) are diluted with additional water at a weight ratio of about 1 part Composition: 1 part Water. The results of these evaluations are set forth in Table 4 below wherein viscosity is set forth as Pa·S.

Figure 2:
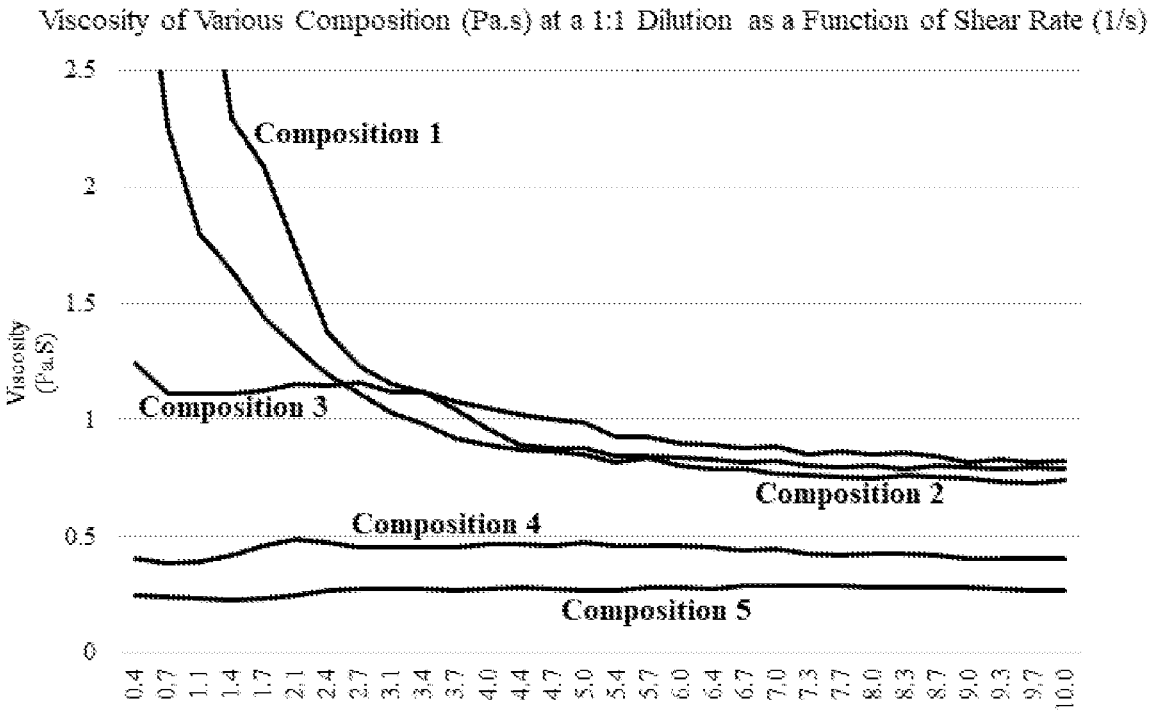
FIG. 2 is a line graph of Viscosity of Compositions 1-5 - Diluted 1:1 With Water—as a Function of Shear Rate, as also set forth in the Examples.

The numerical results set forth in Tables 3 and 4 are visually depicted in the line graphs of FIGS. 1 and 2, respectively.

TABLE 3

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | Dilution at 2 Parts Composition: 1 Part Water Viscosity in Pa · S | | | | |
| 0.41 | 387 | 194.6 | 8.187 | 0.3033 | 0.2633 |
| 0.75 | 192.5 | 112.9 | 5.49 | 0.2755 | 0.2218 |
| 1.08 | 122 | 77.72 | 4.39 | 0.2641 | 0.2063 |
| 1.41 | 90.97 | 58.22 | 3.841 | 0.2558 | 0.1893 |
| 1.73 | 71.29 | 46.39 | 3.584 | 0.2433 | 0.1798 |
| 2.06 | 57.5 | 39.42 | 3.451 | 0.2401 | 0.1736 |
| 2.39 | 48.02 | 34.46 | 3.355 | 0.2413 | 0.1677 |
| 2.72 | 42.56 | 31.27 | 3.251 | 0.2469 | 0.172 |
| 3.06 | 39.94 | 28.81 | 3.15 | 0.2519 | 0.1787 |
| 3.39 | 36.14 | 26.96 | 3.002 | 0.2522 | 0.1819 |
| 3.71 | 32.17 | 25.39 | 2.889 | 0.2467 | 0.1779 |
| 4.05 | 29.49 | 24.15 | 2.769 | 0.2403 | 0.1711 |
| 4.37 | 28.06 | 22.93 | 2.669 | 0.2433 | 0.1709 |
| 4.71 | 26.03 | 21.86 | 2.549 | 0.2481 | 0.1782 |
| 5.03 | 24.35 | 20.85 | 2.484 | 0.245 | 0.1767 |
| 5.37 | 23.01 | 20.02 | 2.381 | 0.2395 | 0.1686 |
| 5.70 | 22.26 | 19.14 | 2.335 | 0.2446 | 0.1714 |
| 6.03 | 21.26 | 18.2 | 2.25 | 0.2438 | 0.1758 |
| 6.36 | 20.03 | 17.43 | 2.189 | 0.2387 | 0.1689 |
| 6.68 | 19.02 | 16.89 | 2.152 | 0.2431 | 0.1714 |
| 7.02 | 18.52 | 16.44 | 2.078 | 0.242 | 0.1732 |
| 7.35 | 17.5 | 16.01 | 2.013 | 0.2382 | 0.1682 |
| 7.68 | 16.47 | 15.38 | 1.997 | 0.243 | 0.173 |
| 8.01 | 16.52 | 14.55 | 1.955 | 0.2375 | 0.168 |
| 8.34 | 16.14 | 13.9 | 1.917 | 0.2417 | 0.1723 |
| 8.67 | 15.49 | 13.82 | 1.907 | 0.2368 | 0.169 |
| 8.99 | 14.72 | 13.71 | 1.878 | 0.2401 | 0.1709 |
| 9.32 | 14.41 | 12.78 | 1.846 | 0.2361 | 0.1682 |
| 9.66 | 14.46 | 12.09 | 1.856 | 0.2395 | 0.1707 |
| 9.99 | 14.18 | 11.94 | 1.848 | 0.2357 | 0.1667 |

TABLE 4

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | Dilution at 1 Part Composition: 1 Part Water Viscosity in Pa · S | | | | |
| 0.41 | 19.54 | 3.318 | 1.241 | 0.4028 | 0.2471 |
| 0.75 | 7.06 | 2.257 | 1.115 | 0.3837 | 0.2418 |
| 1.08 | 3.193 | 1.798 | 1.115 | 0.3903 | 0.2309 |
| 1.41 | 2.29 | 1.641 | 1.111 | 0.419 | 0.2277 |
| 1.73 | 2.085 | 1.445 | 1.126 | 0.4593 | 0.2366 |
| 2.06 | 1.728 | 1.312 | 1.153 | 0.4849 | 0.251 |
| 2.39 | 1.373 | 1.198 | 1.147 | 0.4775 | 0.265 |
| 2.72 | 1.23 | 1.11 | 1.158 | 0.4538 | 0.2743 |
| 3.06 | 1.154 | 1.03 | 1.12 | 0.454 | 0.2779 |
| 3.39 | 1.121 | 0.9846 | 1.119 | 0.4508 | 0.2746 |
| 3.71 | 1.045 | 0.919 | 1.075 | 0.4512 | 0.2694 |
| 4.05 | 0.9616 | 0.8923 | 1.05 | 0.4688 | 0.2768 |
| 4.37 | 0.8958 | 0.8742 | 1.023 | 0.4684 | 0.2819 |
| 4.71 | 0.8772 | 0.8652 | 1.002 | 0.4597 | 0.2771 |
| 5.03 | 0.8769 | 0.8535 | 0.9874 | 0.4709 | 0.2698 |
| 5.37 | 0.8442 | 0.8185 | 0.9276 | 0.4636 | 0.2678 |
| 5.70 | 0.8442 | 0.8391 | 0.9307 | 0.4617 | 0.2816 |
| 6.03 | 0.8409 | 0.8069 | 0.9033 | 0.458 | 0.2823 |
| 6.36 | 0.8293 | 0.7902 | 0.8942 | 0.455 | 0.278 |
| 6.68 | 0.8193 | 0.7927 | 0.8781 | 0.4398 | 0.2883 |
| 7.02 | 0.8252 | 0.7712 | 0.8895 | 0.444 | 0.2866 |
| 7.35 | 0.8042 | 0.7628 | 0.8518 | 0.4258 | 0.2892 |
| 7.68 | 0.7999 | 0.7554 | 0.8665 | 0.4203 | 0.2882 |
| 8.01 | 0.8016 | 0.7479 | 0.8551 | 0.4278 | 0.285 |
| 8.34 | 0.7905 | 0.7617 | 0.8601 | 0.4242 | 0.2853 |
| 8.67 | 0.8017 | 0.7545 | 0.8455 | 0.4223 | 0.2792 |
| 8.99 | 0.796 | 0.7507 | 0.817 | 0.4078 | 0.28 |

TABLE 4-continued

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | Dilution at 1 Part Composition: 1 Part Water Viscosity in Pa · S | | | | |
| 9.32 | 0.792 | 0.7362 | 0.8304 | 0.4089 | 0.2739 |
| 9.66 | 0.7973 | 0.7294 | 0.8206 | 0.4086 | 0.2713 |
| 9.99 | 0.7892 | 0.7452 | 0.822 | 0.4061 | 0.2667 |

As shown in Tables 3 and 4, Composition 1 (comparative) exhibits a tendency to increase in viscosity (e.g. to 10 or greater Pa·S) to varying degrees depending on dilution and shear rate. However, when varying amounts of the glycol ether are added, as shown relative to Compositions 2-5 (inventive), superior and unexpected results are realized. More specifically, the use of the glycol ether surprisingly reduces the viscosity of the detergent composition upon dilution with water which, in turn, allows for larger amounts of water to be included in unit dose packs, allows for simplified formulations to be produced, less chemicals to be used, less chemical waste to be generated, and decreased production costs to be realized. Moreover, use of the glycol ether allows the detergent compositions to maintain cleaning effectiveness after dilution due to the decreased viscosity. This allows the packs to be used in a wider variety of environments.

For example, the glycol ether was found to have a very significant and beneficial impact on controlling rheology when the Composition is diluted with additional water at the various ratios. In one instance, e.g. in Composition 5, the inclusion of the glycol ether at 7.5% reduced the viscosity of the formulation (when diluted at 2 parts Composition to 1 part DI Water) from about 122,000 cP (Composition 1) to about 206 cP (Composition 5) measured at a shear rate of 1.08 1/s. This data also demonstrates the direct relationship between glycol ether inclusion level and lower viscosities, with higher levels of the glycol ether being more favorable. Inclusion levels of glycol ether under 5% significantly impacted the rheology, unlike prior examples. Relative to Composition 5, the glycol ether also controlled rheology at the 1:1 dilution, reducing viscosity from about 3190 cP (Composition 1) to about 231 cP (Composition 5) measured at a shear rate of 1.08 1/s.

FIG. 1 shows that viscosities of Compositions 3-5 are essentially independent of shear. This means the detergent compositions are Newtonian fluids. Compositions 3-5 show a low viscosity. The viscosity of Composition 1 is non-Newtonian.

FIG. 2 also shows that viscosities of Compositions 3-5 are essentially independent of shear. This means the detergent compositions are Newtonian fluids. Compositions 3-5 show a low viscosity. The viscosity of Composition 2 initially exhibits a slight non-Newtonian property at low shear rates but changes to Newtonian at higher shear rate. The viscosity of Composition 1 is non-Newtonian.

As shown in the viscosity curves of Compositions 1-5, increasing the amount of the rheology control agent in the Compositions not only shows a trend of changing the behavior of the fluids (from non-Newtonian to Newtonian) but also gradually lowering the viscosity of the Compositions, upon dilution with water. Both are advantageous for dissolution of unit dose detergent production upon exposed to water during use.

The glycol ether also allows for increased cleaning effectiveness as compared to Composition 1 (comparative) since Composition 1 would go through an increase in viscosity when used. The Compositions 2-5 (inventive) also would be able to exit a partially dissolved unit dose pack with greater ease as well since a water-soluble (e.g. PVOH) film could take upwards of five minutes to dissolve. The water-soluble film of the unit dose pack normally partially dissolves in one area, allowing the contents to leech into the external environment prior to all of the water-soluble film dissolving. Higher viscosity liquids have a more difficult time exiting a partially dissolved unit dose pack and thus take longer to leech. This increases cleaning time and may also decrease cleaning effectiveness.

For the sake of comparison, additional viscosity evaluations of non-diluted Compositions are performed using an AR2000-EX Rheometer using an increasing shear rate of from about 0.41 to about 10 1/s over 5 minutes at 20° C. with a geometry cone of 40 mm, 1:59:49 degree:min:sec, and a truncation gap of 52 microns.

More specifically, the Compositions 1-5 above are evaluated to determine non-diluted viscosity. These results are set forth in Table 5 below.

TABLE 5

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | No Dilution in Water Viscosity in Pa · S | | | | |
| 0.41 | 0.2435 | 0.4155 | 0.4085 | 0.4106 | 0.07936 |
| 0.75 | 0.2359 | 0.186 | 0.2026 | 0.1794 | 0.09709 |
| 1.08 | 0.2326 | 0.1889 | 0.1895 | 0.1584 | 0.1033 |
| 1.41 | 0.2316 | 0.1932 | 0.1827 | 0.1417 | 0.107 |
| 1.73 | 0.2303 | 0.1929 | 0.1801 | 0.1365 | 0.1168 |
| 2.06 | 0.2272 | 0.1988 | 0.1718 | 0.1291 | 0.1257 |
| 2.39 | 0.2254 | 0.2036 | 0.1663 | 0.1276 | 0.1245 |
| 2.72 | 0.2235 | 0.2024 | 0.1609 | 0.1313 | 0.1208 |
| 3.06 | 0.2235 | 0.1974 | 0.1643 | 0.1411 | 0.1131 |
| 3.39 | 0.2257 | 0.194 | 0.1683 | 0.1413 | 0.1058 |
| 3.71 | 0.2272 | 0.1939 | 0.1714 | 0.1366 | 0.1092 |
| 4.05 | 0.2261 | 0.1979 | 0.168 | 0.1307 | 0.1186 |
| 4.37 | 0.2234 | 0.1996 | 0.1631 | 0.1324 | 0.1184 |
| 4.71 | 0.2237 | 0.1966 | 0.1654 | 0.1394 | 0.1098 |
| 5.03 | 0.2264 | 0.1945 | 0.1707 | 0.1372 | 0.1098 |
| 5.37 | 0.225 | 0.1993 | 0.167 | 0.1309 | 0.1177 |
| 5.70 | 0.224 | 0.1991 | 0.1647 | 0.1354 | 0.1138 |
| 6.03 | 0.2257 | 0.1944 | 0.1707 | 0.1391 | 0.1099 |
| 6.36 | 0.2255 | 0.1987 | 0.1677 | 0.1322 | 0.1168 |
| 6.68 | 0.2237 | 0.1984 | 0.1657 | 0.1364 | 0.1136 |
| 7.02 | 0.2264 | 0.1956 | 0.1701 | 0.1366 | 0.111 |
| 7.35 | 0.2246 | 0.1991 | 0.1667 | 0.1335 | 0.1171 |
| 7.68 | 0.2256 | 0.197 | 0.1678 | 0.138 | 0.1099 |
| 8.01 | 0.2261 | 0.1987 | 0.168 | 0.1334 | 0.1163 |
| 8.34 | 0.2252 | 0.1982 | 0.1671 | 0.1383 | 0.112 |
| 8.67 | 0.2264 | 0.1978 | 0.17 | 0.1352 | 0.1158 |
| 8.99 | 0.2251 | 0.1987 | 0.1673 | 0.1379 | 0.1131 |
| 9.32 | 0.2265 | 0.1981 | 0.1699 | 0.1353 | 0.1156 |
| 9.66 | 0.2255 | 0.1989 | 0.1677 | 0.1384 | 0.1124 |
| 9.99 | 0.2265 | 0.1997 | 0.1689 | 0.1345 | 0.1159 |

These results show that, without dilution, the Compositions have relatively similar viscosities at varying shear rates. These results also show that it is the dilution with water that causes the rapid increases in viscosity of comparative Composition 1 that does not include the glycol ether. These results also further support the conclusion that it is the glycol ether that is surprisingly responsible for the trend of changing the behavior of the fluids, from non-Newtonian to Newtonian.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A unit dose detergent pack comprising:

a pouch made of a water-soluble film; and a detergent composition encapsulated within said pouch, wherein said detergent composition consists essentially of:

A. a rheology modified surfactant system consisting of:

(1) a surfactant blend consisting of sodium laureth ether sulfate that is ethoxylated with from about 2 to about 4 moles of ethylene oxide and is present in an amount of from about 15 to about 20 weight percent actives based on a total weight of said detergent, a linear alkylbenzene sulfonate present in an amount of from about 1 to about 20 weight percent actives based on a total weight of said detergent composition, an ethoxylated alcohol present in an amount of from about 1 to about 30 weight percent actives based on a total weight of said detergent composition, and coconut oil fatty acid; and (2) a rheology modifying agent consisting of:

(a) water present in a total amount of from about 5 to about 20 weight percent based on a total weight of said detergent composition; and (b) a butyl carbitol present in an amount of about 2.5 to about 7.5 weight percent actives based on a total weight of said detergent composition, and B. at least one adjunct chosen from glycerine, propylene glycol, monoethanolamine, a bittering agent, an enzyme, an optical brightener, a chelator, a fragrance, and combinations thereof, wherein said glycerine is present in a total amount of from about 7.4 to about 12.4 weight percent actives based on a total weight of said detergent composition;

wherein said detergent composition has a viscosity of less than about 5,000 cps when diluted with additional water at about a 2:1 weight ratio of detergent composition: water, measured using an AR2000-EX rheometer at shear rate of 1.08 1/s at 20° C. with a geometry cone of 40 mm, 1:59:49 degree:min:sec, and a truncation gap of 52 microns;

wherein the at least one adjunct does not affect the viscosity of the detergent composition more than ±5%; and wherein the detergent composition is free of ionic liquids, polyglycols, alkoxylated polyamines, glycol and ethanol blends, poloxamers and alkyl alcohol blends, and combinations thereof.

2. The unit dose pack of claim 1 wherein the butyl carbitol is present in an amount of about 2.5 weight percent actives based on a total weight of said detergent composition and the viscosity of said detergent composition is less than about 4,500 cps when said detergent composition is diluted with additional water at about a 2:1 weight ratio of detergent composition:water, or the viscosity of said detergent composition is less than about 1,200 cps when said detergent composition is diluted with additional water at about a 1:1 weight ratio of detergent composition:water.

3. The unit dose pack of claim 1 wherein the butyl carbitol is present in an amount of about 5 weight percent actives based on a total weight of said detergent composition and the viscosity of said detergent composition is less than about 275 cps when said detergent composition is diluted with additional water at about a 2:1 weight ratio of detergent composition:water or the viscosity of said detergent composition is less than about 400 cps when said detergent composition is diluted with additional water at about a 1:1 weight ratio of detergent composition:water.

4. The unit dose pack of claim 1 wherein the butyl carbitol is present in an amount of about 7.5 weight percent actives based on a total weight of said detergent composition and the viscosity of said detergent composition is less than about 210 cps when said detergent composition is diluted with additional water at about a 2:1 weight ratio of detergent composition:water or the viscosity of said detergent composition is less than about 230 cps when said detergent composition is diluted with additional water at about a 1:1 weight ratio of detergent composition:water.

5. The unit dose pack of claim 1 wherein said butyl carbitol is present in an amount of from about 2.5 to about 5 weight percent actives based on a total weight of said detergent composition.

6. The unit dose pack of claim 1 wherein said butyl carbitol is present in an amount of from about 5 to about 7.5 weight percent actives based on a total weight of said detergent composition.

7. The unit dose pack of claim 1 wherein said sodium laureth ether sulfate and said butyl carbitol are present in a weight ratio of actives of said sodium laureth ether sulfate to said butyl carbitol of about 16:(2.5 to 7.5).

8. The unit dose pack of claim 1 wherein said propylene glycol is present in an amount of from about 8.2 weight percent actives based on a total weight of said detergent composition;

and wherein said monoethanolamine is present in an amount of from about 3.2 weight percent actives based on a total weight of said detergent composition.

9. The unit dose pack of claim 1 wherein said linear alkylbenzene sulfonate is present in an amount of about 5 weight percent actives based on a total weight of said detergent composition.

10. The unit dose pack of claim 1 wherein said coconut oil fatty acid is present in an amount of about 10 weight percent actives based on a total weight of said detergent composition.

11. A detergent composition consisting of:

butyl carbitol present in an amount of from about 2.5 to about 7.5 weight percent actives based on a total weight of said detergent composition;

glycerine present in an amount of from about 7.4 to about 12.4 weight percent actives based on a total weight of said detergent composition;

a C12-C15 alcohol ethoxylate that is ethoxylated with 7 moles of ethylene oxide and is present in an amount of from about 23 weight percent actives based on a total weight of said detergent composition;

propylene glycol present in an amount of from about 8.2 weight percent actives based on a total weight of said detergent composition;

monoethanolamine present in an amount of from about 3.2 weight percent actives based on a total weight of said detergent composition;

water present in an amount of from about 5 to about 20 weight percent based on a total weight of said detergent composition;

linear alkylbenzene sulfonate present in an amount of from about 5 weight percent actives based on a total weight of said detergent composition;

coconut oil fatty acid present in an amount of from about 10 weight percent actives based on a total weight of said detergent composition;

sodium laureth ether sulfate present in an amount of from about 15.6 weight percent actives based on a total weight of said detergent composition;

and optionally one or more of the following such that a total weight of all component is 100 percent by weight:

one or more bittering agents;

one or more enzymes;

one or more optical brighteners;

one or more chelators;

one or more fragrances; or combinations thereof, wherein said detergent composition has a viscosity of less than about 5,000 cps when diluted with additional water at about a 2:1 weight ratio of detergent composition: water, measured using an AR2000-EX rheometer at shear rate of 1.08 1/s at 20° C. with a geometry cone of 40 mm, 1:59:49 degree:min:sec, and a truncation gap of 52 microns.

12. The detergent composition of claim 11 wherein said butyl carbitol is present in an amount of from about 2.5 to about 5 weight percent actives based on a total weight of said detergent composition.

13. The detergent composition of claim 11 wherein said butyl carbitol is present in an amount of from about 5 to about 7.5 weight percent actives based on a total weight of said detergent composition.

14. The detergent composition of claim 11 wherein said butyl carbitol is present in an amount of about 2.5 weight percent actives based on a total weight of said detergent composition.

15. The detergent composition of claim 11 wherein said butyl carbitol is present in an amount of about 5 weight percent actives based on a total weight of said detergent composition.

16. The detergent composition of claim 11 wherein said butyl carbitol is present in an amount of about 7.5 weight percent actives based on a total weight of said detergent composition.

* * * * *